United States Patent [19]

Peel

[11] Patent Number: 5,022,613

[45] Date of Patent: Jun. 11, 1991

[54] AC AND BATTERY BACKUP SUPPLY FOR A RAILROAD CROSSING GATE

[75] Inventor: Richard V. Peel, Upland, Calif.

[73] Assignee: Safetran Systems Corporation, Minneapolis, Minn.

[21] Appl. No.: 514,980

[22] Filed: Apr. 26, 1990

[51] Int. Cl.[5] ..... B61L 29/22; H05B 37/04

[52] U.S. Cl. ..... 246/125; 315/86; 362/20

[58] Field of Search ..... 246/111, 113, 114 R, 246/114 A, 125, 126, 128, 473 R; 362/20; 315/86, 87

[56] References Cited

U.S. PATENT DOCUMENTS

| | | | |
|---|---|---|---|
| 2,476,517 | 7/1949 | Titus | 315/87 |
| 3,781,541 | 12/1973 | Darrow et al. | 246/128 |
| 3,838,271 | 9/1974 | Ackard et al. | 246/125 |
| 3,869,639 | 3/1975 | Herzog | 315/87 X |
| 3,944,173 | 3/1976 | Moe et al. | 246/128 X |
| 4,177,500 | 12/1979 | Nicholl et al. | 362/20 |
| 4,349,863 | 9/1982 | Petersen | 362/20 |
| 4,461,974 | 7/1984 | Chiu | 362/20 X |
| 4,703,303 | 10/1987 | Snee | 246/125 |
| 4,934,633 | 6/1990 | Ballinger et al. | 246/125 X |

FOREIGN PATENT DOCUMENTS

| | | | |
|---|---|---|---|
| 2287796 | 5/1976 | France | 315/87 |

*Primary Examiner*—David A. Bucci
*Assistant Examiner*—Scott L. Lowe
*Attorney, Agent, or Firm*—Kinzer, Plyer, Dorn, McEachran & Jambor

[57] ABSTRACT

A crossing lights controller for effecting operation of the crossing lights during normal train operating conditions and during a controller failure mode includes a train sensing input, a lights control circuit, a solid state logic and monitor circuit, an independent source of both AC and DC power, and a fail-safe relay. The train sensing input provides one signal condition when the approach of a train is sensed and another signal condition when no train is sensed. The lights control circuit has power supplied thereto to operate the lights in a flashing condition when the train sensing input indicates the approach of a train. The solid state logic and monitor circuit is connected to the input circuit and the lights control circuit and applies and removes power to the lights control circuit in accordance with signals at the input. The fail-safe relay is connected to the logic and monitor circuit and the lights control circuit, with the fail-safe relay automatically connecting the independent source of both AC and DC power to operate the lights in the event no power is supplied to the fail-safe relay.

4 Claims, 1 Drawing Sheet

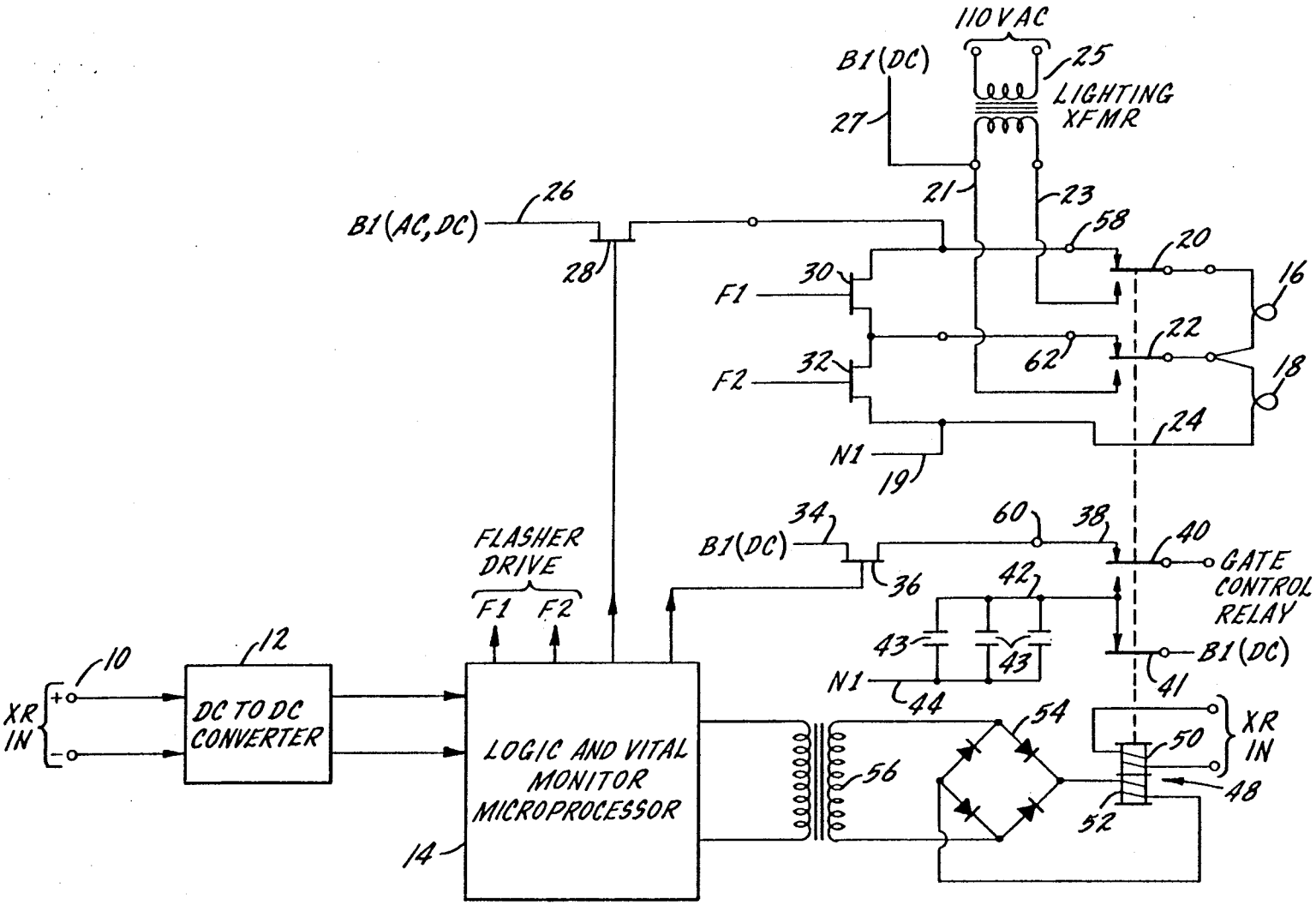
110 VAC
LIGHTING XFMR
B1(DC)
B1(AC,DC)
GATE CONTROL RELAY
B1(DC)
XR IN
F1
F2
N1
N1
FLASHER DRIVE
F1
F2
LOGIC AND VITAL MONITOR MICROPROCESSOR
DC TO DC CONVERTER
XR IN
10
12
14
16
18
19
20
21
22
23
24
25
26
27
28
30
32
34
36
38
40
41
42
43
43
44
48
50
52
54
56
58
60
62

AC AND BATTERY BACKUP SUPPLY FOR A RAILROAD CROSSING GATE

SUMMARY OF THE INVENTION

The present invention relates to controllers for railroad grade crossings and in particular to a controller for effecting operation of the crossing lights, both during normal train operating conditions and during a controller failure mode.

A primary purpose of the present invention is to provide a crossing lights controller which has solid state logic, utilizes a fail-safe relay to insure that under any abnormal condition the lights will be powered, and has an independent source of both AC and DC power which can be applied to the lights in the event of a failure or abnormal condition.

Another purpose is a crossing lights controller of the type described in which, under a failure or abnormal condition, applies DC power to a portion of the lights and AC power to another portion of the lights.

Another purpose of the invention is to provide a crossing lights controller as described in which both AC and DC power will be applied to the lights under abnormal conditions, with the DC power remaining for the length of battery life.

Other purposes will appear in the ensuing specification, drawing and claims.

BRIEF DESCRIPTION OF THE DRAWINGS

The invention is illustrated in the attached block diagram of the control circuit described herein.

DESCRIPTION OF THE PREFERRED EMBODIMENT

In the railroad industry safety is a paramount concern and in such areas as railroad signal systems and railroad air brakes, whenever there is what appears to be a failure, the train brakes are operated or the signal system goes dark, which is an indication to a train crew of a red or "danger" condition. Thus, what can be perceived as a system failure has the effect of shutting down train operations.

The situation is somewhat different at a railroad grade crossing, as in that situation, when there is what can be perceived as a failure mode, the crossing equipment must be operated. The gate must come down and the signal lights must be illuminated. Accordingly, it is necessary to provide a means to automatically insure that any type of abnormal condition will effectively cause the lights and the gate to function in a manner so as to warn a person using the grade crossing.

In the railroad industry certain components have the term "vital" applied thereto when such components are required to never be able to fail, or always to operate in a predetermined manner in the event of a failure of some other part of the system. In the present invention, a relay has been termed a vital relay in that whenever certain conditions are brought about in the grade crossing control, this relay will have its contacts always move to a certain predetermined position, which position is effective to cause operation of the gate and illumination of the signal lights. Such a vital relay is shown in U.S. Pat. No. 4,703,303, assigned to the assignee of the present application, in which it is combined with solid state logic which insures operation of the grade crossing equipment in the normal manner and also insures that the vital relay will function in the appropriate manner in an emergency situation.

It is customary in grade crossing control equipment as described for the signal lights to be illuminated in the event of any type of abnormal condition and the power in such instance is conventionally supplied by a battery. However, if the crossing is in a remote location, it is possible for the battery to be depleted before the abnormal condition at the grade crossing is detected. In that instance there would be no lights, flashing or otherwise, to alert someone using the crossing. The present invention provides a separate and independent source of power, both AC and battery, for operating the crossing lights in the event of an abnormal condition. The terms "separate" and "independent" refer to power from terminals other than those supplying normal operating power, although in the case of AC power it may be the same ultimate source as supplies normal operating power. AC power is normally available locally and a battery supply is conventionally available at a railroad crossing. The AC supply will be connected to at least one of the crossing lights under an abnormal condition and the DC supply or battery will be connected to at least one light. The DC supply may be depleted over time, but the AC supply will remain active and thus there will continue to be illuminated lights at the crossing, even if the abnormal condition is not detected for a long period of time.

In the drawing, an input is indicated at 10 and will be the input signal from the motion sensing circuit which is used at grade crossings to detect the presence of an approaching train and thereby cause operation of the gates and lights. U.S. Pat. No. 3,944,173, assigned to the assignee of the present application, illustrates a railroad crossing motion detector of the type which may be used to provide an input at terminals 10. Terminals 10 are connected to a DC-to-DC converter 12 which converts the voltage level at terminals 10 to a level more appropriate for the logic circuit to be described. The normal input to terminals 10 may be a signal at a predetermined voltage level or frequency when there is no train approaching or present. When a train has been sensed, the output from the motion detector may be a signal of differing characteristics, e.g. no input or a steady state input at terminals 10 and such a signal is known to indicate that the crossing apparatus should be operated.

A logic and vital monitor microprocessor is indicated at 14 and is connected to converter 12 and thus receives an input of the signal indicating the presence or absence of a train at the crossing. Logic microprocessor 14 will have programmed firmware to perform the functions described below.

Warning lights are indicated at 16 and 18, with these lights representing the plurality of lights which are normally present at every grade crossing. Light 16 is connected to a relay contact arm 20 and a relay contact arm 22. Light 18 is connected to relay contact arm 22 and to a fixed contact 24. Contact arms 20 and 22 are movable between upper and lower contacts, with the normal position of the relays being for the arms to be in contact with the upper contacts.

A source of either AC or DC power is applied to a terminal 26 which is connected to a switch 28, the position of which is controlled by logic microprocessor 14. The other side of switch 28 is connected to the upper contact for contact arm 20. The other terminal N1 for the power source is indicated at 19. If the signal lights are operated by AC power, the terminals designate the hot side of the line and ground, whereas, if DC power is being applied, the terminals will be positive and negative. Flasher drive switches 30 and 32 are connected across the relay contacts which cooperate with contact arms 20 and 22 and contact 24 to cause operation of the lights. The flashers cause the well known flashing or periodic application of power to lights 16 and 18. The control for flashers Fl and F2 is indicated to come from logic microprocessor 14 where the flasher drive outputs are indicated.

The lower contact of each of the above-described pairs of contacts is connected to an independent power source by lines 21 and 23. The power source includes an independent AC supply 25 and a battery supply 27. These sources are considered independent because they are not controlled by microprocessor 14.

A crossing gate is normally maintained in the up or raised position by the application of power. Thus, DC power from terminal 34 is applied through a normally closed switch 36 to a contact 38 which cooperates with contact arm 40 to apply DC power to the gate control relay to maintain the gate in an up position. Contact arm 41, connected to power source B1, is connected to one side 42 of a plurality of parallel connected capacitors 43, the other side of which is connected to terminal N1 indicated at 44.

Under normal conditions, power is supplied from terminal 34 to the gate control relay, which holds the gate in a raised position. Capacitors 43 will charge up to the battery voltage applied to the gate control relay. The. number of capacitors and their size will depend on the desired time delay for lowering of the gate and the resistance and quantity of the gate control relays. Various manufacturers have gate control relays with differing resistance and thus the number and size of capacitors must of necessity vary to accommodate a predetermined delay period.

The vital relay is indicated at 48 and may have two relay coils, an upper coil, indicated at 50, having a direct connection to input 10, and a lower coil 52 connected to a bridge rectifier 54 and through a transformer 56 to logic circuit 14. Power to either of coils 50 or 52 will maintain contact arms 20, 22 and 40 in the position shown. Under normal operating conditions, power will be supplied to coil 52 by logic circuit 14.

Under normal operating conditions, the gate control circuit and the lights control circuit have their relay contacts in the position shown. As long as a predetermined signal is present at input terminal 10, logic microprocessor 14 will maintain switch 28 in the open position and switch 36 in the closed position. Thus, power is supplied to the gate to maintain it in a raised position and no power is supplied to the warning lights. In the event a train is sensed on the section of track adjacent to the grade crossing, there will be a change in the signal at input 10, which change will cause the logic and vital monitor microprocessor to close switch 28 and open switch 36. The flasher drive will also be activated. The closing of switch 28 will apply power to illuminate the lights and the flashers will simultaneously function to provide the well-known flashing light condition. The removal of power by the opening of switch 36 will cause the gate to be lowered, as it is maintained in a raised position by the application of power to the gate control relay.

There are three circuit condition sensors which are monitored by logic microprocessor 14. Sensor 58 monitors the application of power to the lights. Sensor 60 monitors the application of power to the gate circuit and sensor 62 monitors the rate at which the flashers function. At such time as there is a change in signal at terminals 10, the gate and lights will function in the manner described, providing that each of sensors 58, 60 and 62 indicates that power is applied to the lights, power is not applied to the gate, and the flashers are functioning in a normal manner. In the event that any one of the three described sensors gives an indication which is not appropriate for a train-present input signal to the logic circuit from terminals 10, the logic microprocessor will remove power from transformer 56, and thus from coil 52, of vital relay 48. Since there is no power to coil 50, contact arms 20, 22, 40 and 41 will each move to a position opposite that shown in the drawing. When any malfunction is detected by any one of the three sensors, the vital relay will operate automatically. Similarly, if there is a loss of power in the logic circuit, the vital relay will function, assuming no signal at input 10, which will cause all of the contact arms controlled by coils 50 and 52 to move to a position opposite that shown in the drawings. The vital relay is either so mechanically positioned or the contact arms have spring control such that in the event of a loss of power to coils 50 and 52, the contact arms will automatically move away from the position shown.

When contact arms 20 and 22 move to a down position, light 16 will be directly connected across independent AC source 25 and will thus be illuminated by this power supply. Light 18 will be connected between Nl terminal 19 and the independent positive battery terminal 27 such that light 18 will be illuminated by the battery. It should be understood that lights 16 and 18 are merely representative of portions of the total lights at the grade crossing. Thus, some of the grade crossing lights will be on AC power and some will be on DC or battery power. Even if the battery supply deteriorates with time, there will always be some of the crossing lights illuminated by the AC power to provide warning to those approaching the crossing.

In the case of contact arms 40 and 41, movement to the lower position removes power to the gate control relay. Normally, the gate would begin to lower. However, because a certain delay time is desired, the gate control relay will continue to be operated and thus hold the gate in the raised position until the charge on capacitors 43 has been dissipated. The period of delay will depend on what is desired and necessary for a particular crossing which, along with the resistance of the gate relay, will determine the number and size of the capacitors.

Whereas the preferred form of the invention has been shown and described herein, it should be realized that there may be many modifications, substitutions and alterations thereto.

The embodiments of the invention in which an exclusive property or privilege is claimed are defined as follows:

1. A crossing lights controller for effecting operation of the crossing lights during normal train operating conditions and during a controller failure mode including, a train sensing input providing one signal condition when the approach of a train is sensed and another signal condition when no train is sensed, a lights control circuit which has power supplied thereto to operate the lights in a flashing condition when the train sensing input indicates the approach of a train, a solid state logic and monitor circuit connected to said input and lights control circuit, said logic and monitor circuit applying and removing power to said light control circuit in accordance with the signals at said input, a source of both AC and DC power, independent of the power to operate the lights in a flashing condition when the train sensing input indicates the approach of a train, and a fail-safe relay connected to said logic and monitor circuit and said lights control circuit, which relay automatically connects said independent source of AC and DC power to operate the lights in the event no power is supplied to the fail-safe relay.

2. The controller of claim 1 further characterized in that said controller effects operation of a crossing gate during normal train operating conditions and during a controller failure mode, said controller including a gate control circuit which has power supplied thereto to maintain the gate in a raised position when the train sensing input indicates a no-train condition, said solid state logic and monitor circuit being connected to said gate control circuit and applying and removing power thereto in accordance with the signals at said input, said fail-safe relay being connected to said gate control circuit and automatically removing power thereto in the event no power is applied to said fail-safe relay.

3. The crossing light controller of claim 1 further characterized in that said fail-safe relay has contacts which apply AC power from said independent source to at least one crossing light and DC power from said independent source to at least another one of said crossing lights in the event no power is applied to said fail-safe relay.

4. The crossing light controller of claim 3 further characterized in that said independent AC source of power and said independent DC source of power have a common terminal connected to the contacts of said fail-safe relay.

* * * * *